US006278414B1

(12) United States Patent
Filipovic

(10) Patent No.: US 6,278,414 B1
(45) **Date of Patent: *Aug. 21, 2001**

(54) BENT-SEGMENT HELICAL ANTENNA

(75) Inventor: Daniel Filipovic, San Diego, CA (US)

(73) Assignee: Qualcomm Inc., San Diego, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/690,023

(22) Filed: Jul. 31, 1996

(51) Int. Cl.[7] ..... H01Q 1/36
(52) U.S. Cl. ..... 343/895; 343/792.5
(58) Field of Search ..... 343/895, 792.5, 343/700 MS, 829, 846, 853; H01R 1/36; H01Q 11/02, 11/14, 11/08, 21/00, 23/00, 1/38

(56) References Cited

U.S. PATENT DOCUMENTS

| | | | | |
|---|---|---|---|---|
| 3,369,243 | * | 2/1968 | Greiser | 343/792.5 |
| 4,008,879 | * | 2/1977 | Smith | 343/895 |
| 4,148,030 | | 4/1979 | Foldes | 343/895 |
| 4,349,824 | | 9/1982 | Harris | 343/700 |
| 4,400,702 | | 8/1983 | Tanaka | 343/790 |
| 4,658,268 | | 4/1987 | DuHamel | 343/792.5 |
| 4,725,845 | | 2/1988 | Phillips | 343/702 |
| 5,134,422 | * | 7/1992 | Auriol | 343/895 |
| 5,198,831 | | 3/1993 | Burrell et al. | 343/895 |
| 5,255,005 | * | 10/1993 | Terrret et al. | 343/895 |
| 5,298,910 | | 3/1994 | Takei et al. | 343/895 |
| 5,346,300 | * | 9/1994 | Yamamoto et al. | 343/895 |
| 5,349,365 | | 9/1994 | Ow et al. | 343/895 |
| 5,359,340 | | 10/1994 | Yokota | 343/792 |
| 5,450,093 | | 9/1995 | Kim | 343/895 |
| 5,479,180 | | 12/1995 | Lenzing et al. | 343/729 |
| 5,485,170 | * | 1/1996 | Mccarrick | 343/895 |
| 5,541,617 | | 7/1996 | Connolly et al. | 343/895 |
| 5,559,524 | * | 9/1996 | Takei et al. | 343/895 |
| 5,581,268 | * | 12/1996 | Hirshfield | 343/895 |
| 5,600,341 | | 2/1997 | Thill et al. | 343/895 |
| 5,612,707 | | 3/1997 | Vaughan et al. | 343/895 |

FOREIGN PATENT DOCUMENTS

| | | | |
|---|---|---|---|
| 0320404 | 6/1989 | (EP) | H01Q/11/08 |
| 0715369 | 6/1996 | (EP) | H01Q/11/08 |
| 0757406 | 2/1997 | (EP) | H01Q/11/08 |
| 0905513 | 11/1997 | (EP) | H01Q/11/08 |
| 0323661 | 10/1991 | (JP) | H01Q/9/27 |
| 9711507 | 3/1997 | (WO) | H01Q/11/08 |
| 9805087 | 2/1998 | (WO) | H01Q/1/36 |

OTHER PUBLICATIONS

Jalil Rashed et al., "A New Class of Resonant Antennas", *IEEE Transaction on Antennas and Propagation*, vol. 39, No. 9, Sep. 9, 1991, pp. 1428–1430.

John D. Kraus, "Antennas", Second Edition, McGraw–Hill, Inc., New York, 1988, Chapter 7 and Section 11–9.

* cited by examiner

*Primary Examiner*—Tho Phan
(74) *Attorney, Agent, or Firm*—Phillip R. Wadsworth; Gregory D. Ogrod

(57) ABSTRACT

A bent-segment helical antenna utilizes one or more radiators wrapped in a helical fashion. The radiators are comprised of a plurality of segments. A first segment extends from a feed network at a first end of a radiator portion of the antenna toward a second end of the radiator portion. A second segment is adjacent to and offset from the first segment. A third segment connects the first and second segments at the second end of the radiator portion.

34 Claims, 11 Drawing Sheets

BENT-SEGMENT HELICAL ANTENNA

RELATED APPLICATIONS

This application is related to a commonly owned Patent Application filed on even date herewith and entitled "Dual-Band Coupled Segment Helical Antenna", and having Ser. No. 08/690,117, and a second patent application Ser. No. 08/640,298, entitled "Coupled Multi-Segment Helical Antenna," filed on Apr. 30, 1996. The full disclosure of each of these applications is incorporated herein by reference as if reproduced in full below.

BACKGROUND OF THE INVENTION

I. Field of the Invention

This invention relates generally to helical antennas and more specifically to a helical antenna having bent-segment radiators.

II. Field of the Invention

Contemporary personal communication devices are enjoying widespread use in numerous mobile and portable applications. With traditional mobile applications, the desire to minimize the size of the communication device, such as a mobile telephone for example, led to a moderate level of downsizing. However, as the portable, hand-held applications increase in popularity, the demand for smaller and smaller devices increases dramatically. Recent developments in processor technology, battery technology and communications technology have enabled the size and weight of the portable device to be reduced drastically over the past several years.

One area in which reductions in size are desired is the device's antenna. The size and weight of the antenna plays an important role in downsizing the communication device. The overall size of the antenna can impact the size of the device's body. Smaller diameter and shorter length antennas can allow smaller overall device sizes as well as smaller body sizes.

Size of the communication device is not the only factor that needs to be considered in designing antennas for portable applications. Another factor to be considered in designing antennas is attenuation and/or blockage effects resulting from the proximity of the user's head to the antenna during normal operations. Yet another factor is the desired radiation patterns and operating frequencies.

An antenna that finds widespread usage in satellite communication systems is the helical antenna. One reason for the helical antenna's popularity in satellite communication systems is its ability to produce and receive circularly-polarized radiation employed in such systems. Additionally, because the helical antenna is capable of producing a radiation pattern that is nearly hemispherical, the helical antenna is particularly well suited to applications in mobile satellite communication systems and in satellite navigational systems.

Conventional helical antennas are made by twisting the radiators of the antenna into a helical structure. A common helical antenna is the quadrifilar helical antenna which utilizes four radiators spaced equally around a core and excited in phase quadrature (i.e., the radiators are excited by signals that differ in phase by one-quarter of a period or 90°). The length of the radiators is typically an integer multiple of a quarter wavelength of the operating frequency of the communication device. The radiation patterns are typically adjusted by varying the pitch of the radiator, the length of the radiator (in integer multiples of a quarter-wavelength), and the diameter of the core.

Conventional helical antennas can be made using wire or strip technology. With strip technology, the radiators of the antenna are etched or deposited onto a thin, flexible substrate. The radiators are positioned such that they are parallel to each other, but at an obtuse angle to the sides of the substrate, or the eventual central antenna axis. The substrate is then formed, or rolled, into a cylindrical, conical, or other appropriate shape causing the strip radiators to form a helix.

This conventional helical antenna, however, also has the characteristic that the radiators are an integer multiple of one quarter wavelength of the desired resonant frequency, resulting in an overall antenna length that is longer than desired for some portable or mobile applications.

SUMMARY OF THE INVENTION

The present invention is a novel and improved helical antenna having a plurality of helically wound radiators. According to the invention, each radiator is formed in a bent-segment configuration. As a result, for a given operating frequency, a radiator portion of a half wavelength antenna according to the invention is shorter than the radiator portion of a conventional half wavelength antenna.

More specifically, in one embodiment, the radiators are comprised of a plurality of segments. A first segment extends from a feed network at a first end of a radiator portion of the antenna toward a second end of the radiator portion. A second segment is adjacent to and offset from the first segment, and is generally parallel thereto. A third segment connects the first and second segments at the second end of the radiator portion. As a result, the radiator is roughly U-shaped. The terms "U-shape" or "U-shaped" are used in this document to refer to a U-shape, V-shape, hairpin shape, horseshoe shape, or other similar or like shape.

An advantage of the invention is that for a given operating frequency, the radiator portion of the bent-segment antenna can be made smaller than the corresponding conventional helical antenna.

Another advantage of the bent-segment antenna is that embodiments using odd multiples of a quarter-wavelength of interest for the length, can be easily tuned to a given frequency by adjusting the length of the radiator segments by trimming the length of the second segments. The length of the segments is easily modified after the antenna has been made to properly tune the frequency of the antenna.

Yet another advantage of the invention is that its directional characteristics can be adjusted to maximize signal strength in one direction along the axis of the antenna. Thus for certain applications, such as satellite communications for example, the directional characteristics of the antenna can be optimized to maximize signal strength in the upward direction, away from the ground and toward the satellite.

Further features and advantages of the present invention, as well as the structure and operation of various embodiments of the present invention, are described in detail below with reference to the accompanying drawings.

BRIEF DESCRIPTION OF THE DRAWINGS

The features, objects, and advantages of the present invention will become more apparent from the detailed description set forth below when taken in conjunction with the drawings in which like reference characters identify correspondingly throughout and wherein.

DETAILED DESCRIPTION OF THE PREFERRED EMBODIMENTS

I. Overview and Discussion of the Invention

The present invention is directed toward a helical antenna having one or more bent-segment radiators. According to the invention, a radiator of the antenna is comprised of three segments. A first segment extends from a feed network toward a far end of the antenna. A second segment runs adjacent to (preferably, substantially parallel to) and is separated from the first segment. A third segment connects the first and second segments, preferably at the far end. The radiators can be made using wires bent to form the three segments. In an alternative embodiment, the radiators are made using strip technology.

II. Example Environment

In a broad sense, the invention can be implemented in any system for which helical antenna technology can be utilized. One example of such an environment is a communication system in which users having fixed, mobile and/or portable telephones communicate with other parties through a satellite communication link. In this example environment, the telephone is required to have an antenna tuned to the frequency satellite communication link.

The present invention is described in terms of this example environment. Description in these terms is provided for convenience only. It is not intended that the invention be limited to application in this example environment. In fact, after reading the following description, it will become apparent to a person skilled in the relevant art how to implement the invention in alternative environments.

III. Conventional Helical Antennas

Figure 1A:
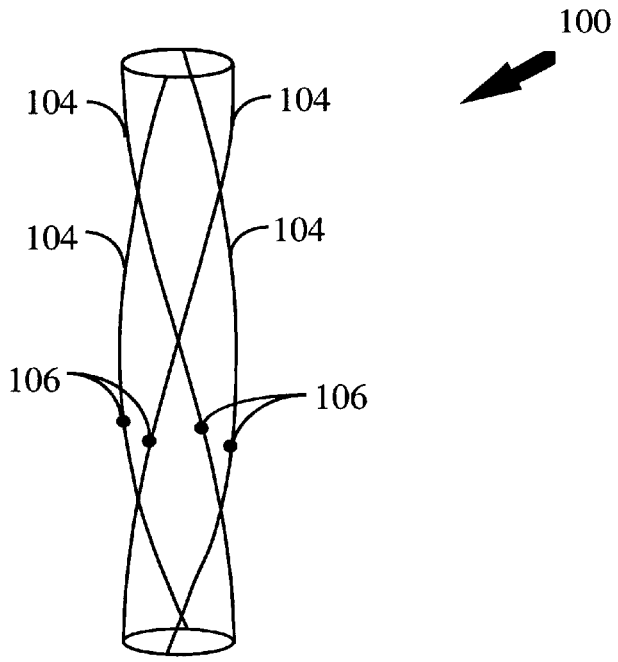
FIG. 1A is a is a diagram illustrating a conventional wire quadrifilar helical antenna.
Figure 1B:
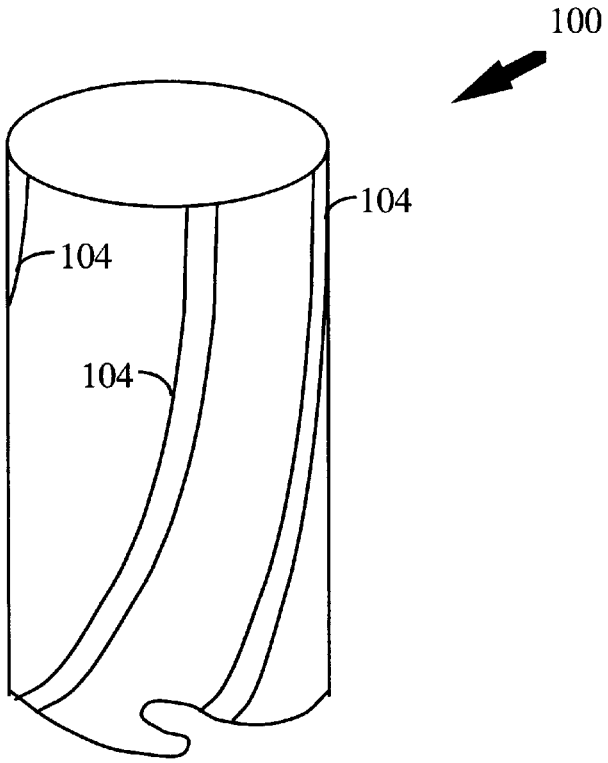
FIG. 1B is a diagram illustrating a conventional strip quadrifilar helical antenna.

Before describing the invention in detail, it is useful to describe the radiator portions of some conventional helical antennas. Specifically, this section of the document describes radiator portions of some conventional quadrifilar helical antennas. FIGS. 1A and 1B are diagrams illustrating a radiator portion 100 of a conventional quadrifilar helical antenna in wire form and in strip form, respectively. The radiator portion 100 illustrated in FIGS. 1A and 1B is that of a quadrifilar helical antenna, meaning it has four radiators 104 operating in phase quadrature. As illustrated in FIGS. 1A and 1B, radiators 104 are wound to provide circular polarization. Possible signal feed points 106 are shown for the radiators in FIG. 1B.

Figure 2A:
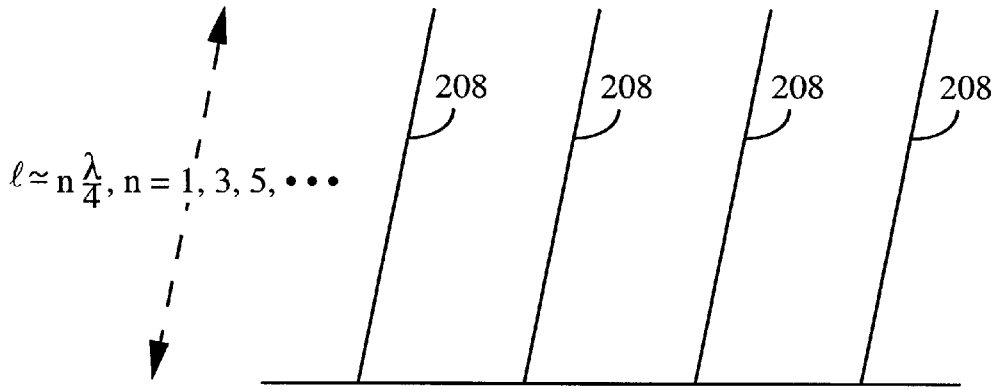
FIG. 2A is a diagram illustrating a planar representation of an open-circuited quadrifilar helical antenna.
Figure 2B:
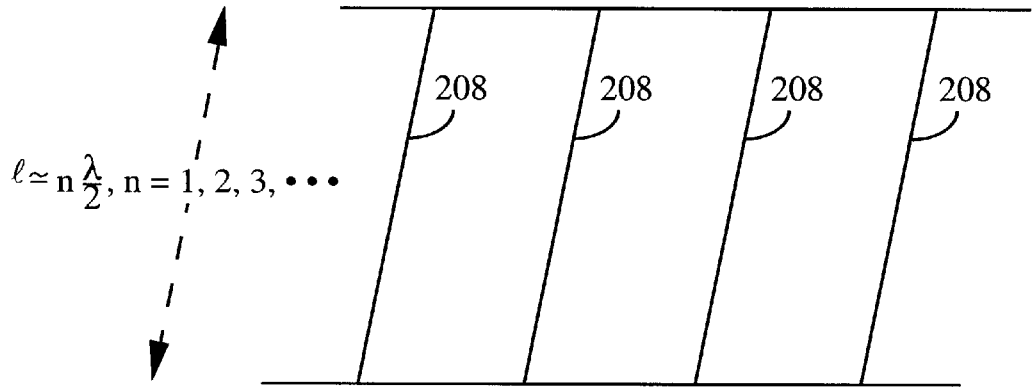
FIG. 2B is a diagram illustrating a planar representation of a short-circuited quadrifilar helical antenna.

FIGS. 2A and 2B are diagrams illustrating planar representations of a radiator portion of conventional quadrifilar helical antennas. In other words, FIGS. 2A and 2B illustrate the radiators as they would appear if the antenna cylinder were "unrolled" on a flat surface. FIG. 2A is a diagram illustrating a quadrifilar helical antenna which is open-circuited at the far end. For such a configuration, the resonant length l of radiators 208 is an odd integer multiple of a quarter-wavelength of the desired resonant frequency.

FIG. 2B is a diagram illustrating a quadrifilar helical antenna which is short-circuited at the far end. In this case the resonant length l of radiators 208 is an even integer multiple of a quarter wavelength of the desired resonant frequency. Note that in both cases, the stated resonant length l is approximate, because a small adjustment is usually needed to compensate for non-ideal short and open terminations.

Figure 3:
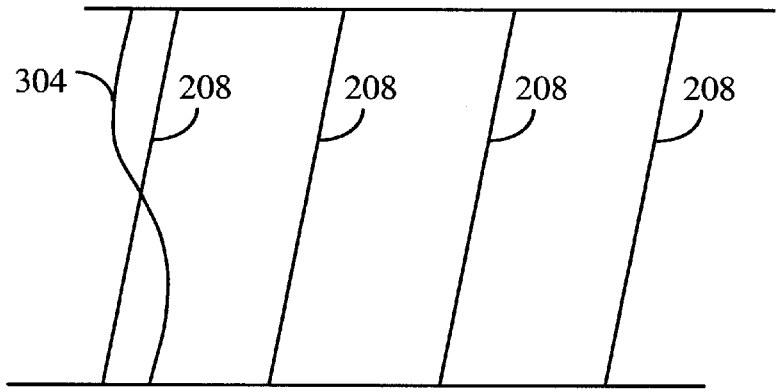
FIG. 3 is a diagram illustrating current distribution on a radiator of a short-circuited quadrifilar helical antenna.

FIG. 3 is a diagram illustrating a planar representation of a radiator portion of a quadrifilar helical antenna 300, which includes radiators 208 having a length $l=\lambda/2$, where $\lambda$ is the wavelength of the desired resonant frequency of the antenna. Curve 304 represents the relative magnitude of current for a signal on a radiator 208 that resonates at a frequency of $f=v/\lambda$, where $v$ is the velocity of the signal in the medium.

Exemplary implementations of a quadrifilar helical antenna implemented using printed circuit board techniques (a strip antenna) are described in more detail with reference to FIGS. 4–6. The strip quadrifilar helical antenna is comprised of strip radiators 104 etched onto a dielectric substrate 406. The substrate is a thin flexible material that is rolled into a cylindrical, conical or other appropriate shape such that radiators 104 are helically wound about a central axis of the cylinder.

Figures 4, 5:
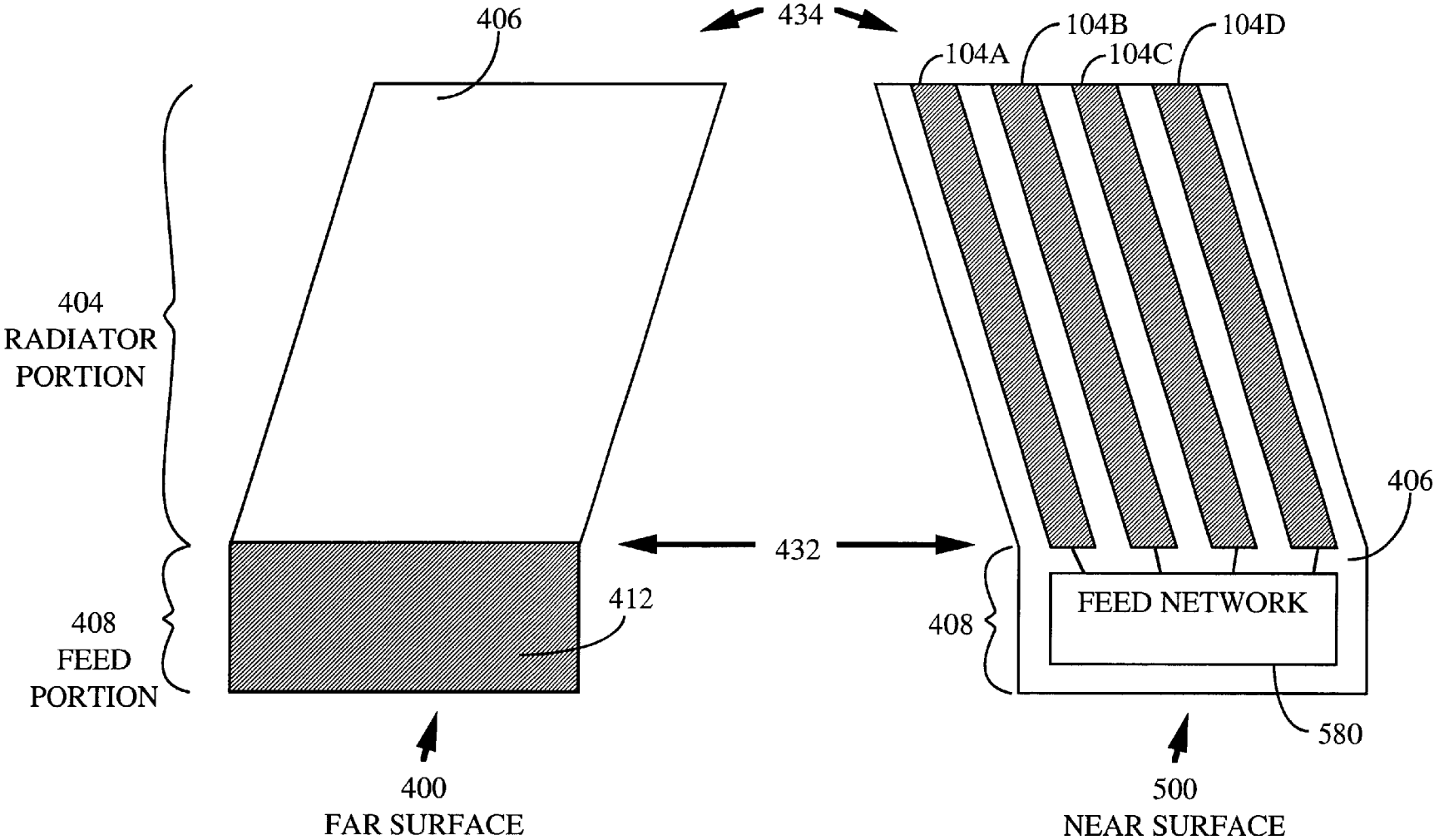
FIG. 4 is a diagram illustrating a far surface of an etched substrate of a strip helical antenna.
FIG. 5 is a diagram illustrating a near surface of an etched substrate of a strip helical antenna.
Figure 6:
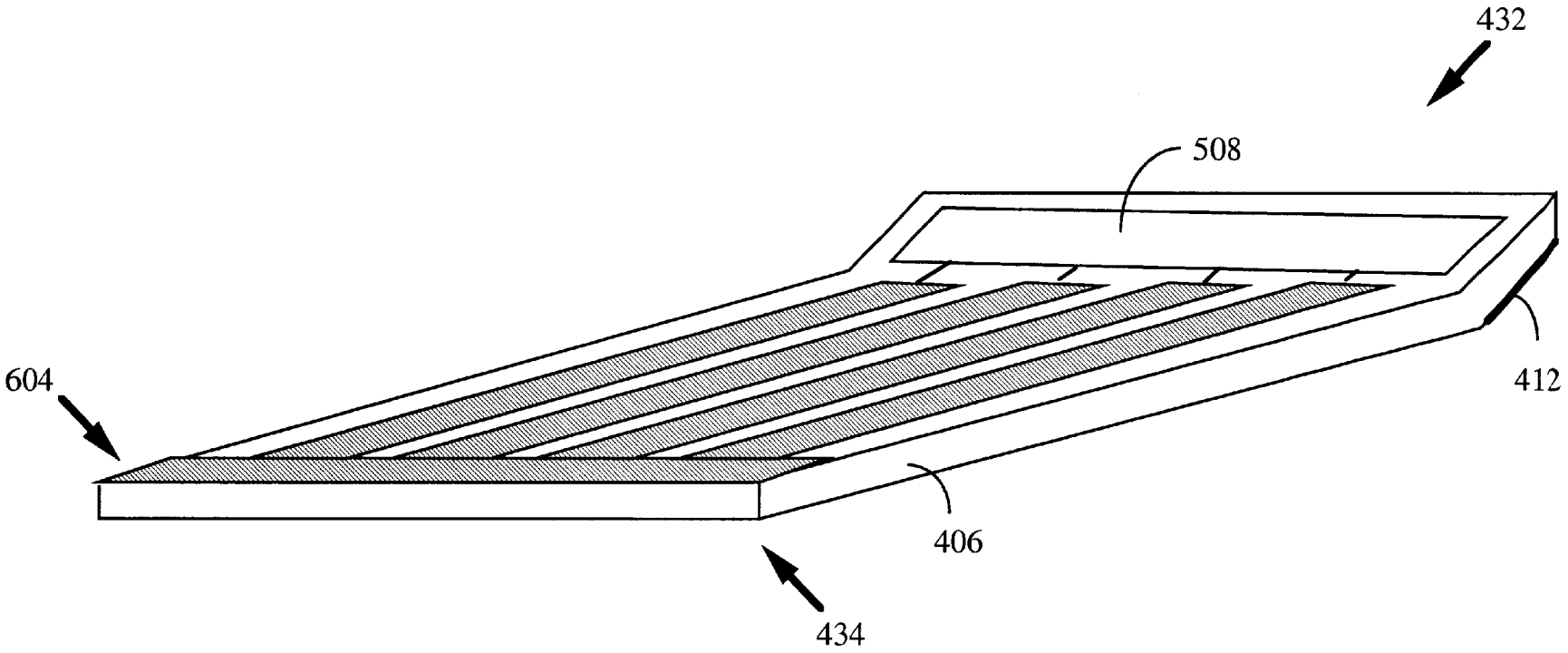
FIG. 6 is a diagram illustrating a perspective view of an etched substrate of a strip helical antenna.

FIGS. 4–6 illustrate the components used to fabricate a quadrifilar helical antenna 100. FIGS. 4 and 5 present a view of a far surface 400 and near surface 500 of substrate 406, respectively. The antenna 100 includes a radiator portion 404, and a feed portion 408.

In the embodiments described and illustrated herein, the antennas are described as being made by forming the substrate into a cylindrical shape with the near surface being on the outer surface of the formed cylinder. In alternative embodiments, the substrate is formed into the cylindrical shape with the far surface being on the outer surface of the cylinder.

In one embodiment, dielectric substrate 100 is a thin, flexible layer of polytetraflouroethalene (PTFE), a PTFE/glass composite, or other dielectric material. In one embodiment, substrate 406 is on the order of 0.005 in., or 0.13 mm thick, although other thicknesses can be chosen. Signal traces and ground traces are provided using copper. In alternative embodiments, other conducting materials can be chosen in place of copper depending on cost, environmental considerations and other factors.

In the embodiment illustrated in FIG. 5, feed network 508 is etched onto feed portion 408 to provide the quadrature phase signals (i.e., the 0°, 90°, 180°, and 270° signals) that are provided to radiators 104. Feed portion 408 of far surface 400 provides a ground plane 412 for feed circuit 508. Signal traces for feed circuit 508 are etched onto near surface 500 of feed portion 408.

For purposes of discussion, radiator portion 404 has a first end 432 adjacent to feed portion 408 and a second end 434 (on the opposite end of radiator portion 404). Depending on the antenna embodiment implemented, radiators 104 can be etched into far surface 400 of radiator portion 404. The length at which radiators 104 extend from first end 432 toward second end 434 is approximately an integer multiple of a quarter wavelength of the desired resonant frequency.

In such an embodiment where radiators 104 are an integer multiple of half-wavelength ($\lambda/2$), radiators 104 are electrically connected (i.e., short circuited) at second end 434. This connection can be made by a conductor across second end 434 which forms a ring 604 around the circumference of the antenna when the substrate is formed into a cylinder. FIG. 6 is a diagram illustrating a perspective view of an etched substrate of a strip helical antenna having a shorting ring 604 at second end 434.

One conventional quadrifilar helical antenna is described in U.S. Pat. No. 5,198,831 to Burrell, et. al. (referred to as the '831 patent), which is incorporated herein by reference. The antenna described in the '831 patent is a printed circuit-board antenna having the antenna radiators etched or otherwise deposited on a dielectric substrate. The substrate is formed into a cylinder resulting in a helical configuration of the radiators.

Another conventional quadrifilar helical antenna is disclosed in U.S. Pat. No. 5,255,005 to Terret et al (referred to as the '005 patent) which is incorporated herein by reference. The antenna described in the '005 patent is a quadrifilar helical antenna formed by two bifilar helices positioned orthogonally and excited in phase quadrature. The disclosed antenna also has a second quadrifilar helix that is coaxial and electromagnetically coupled with the first helix to improve the passband of the antenna.

Yet another conventional quadrifilar helical antenna is disclosed in U.S. Pat. No. 5,349,365, to Ow et al (referred to as the '365 patent) which is incorporated herein by reference. The antenna described in the '365 patent is a quadrifilar helical antenna designed in wireform as described above with reference to FIG. 1A.

IV. Bent-Segment Helical Antenna Embodiments

Having thus briefly described various forms of a conventional helical antenna, a bent-segment helical antenna according to the invention is now described in terms of several helical embodiments. In order to reduce the length of the radiator portion of the antenna, the invention utilizes bent segment radiators that allow for resonance at a given frequency at shorter overall lengths than would otherwise be needed for a conventional helical antenna having straight radiators.

Figure 7A:
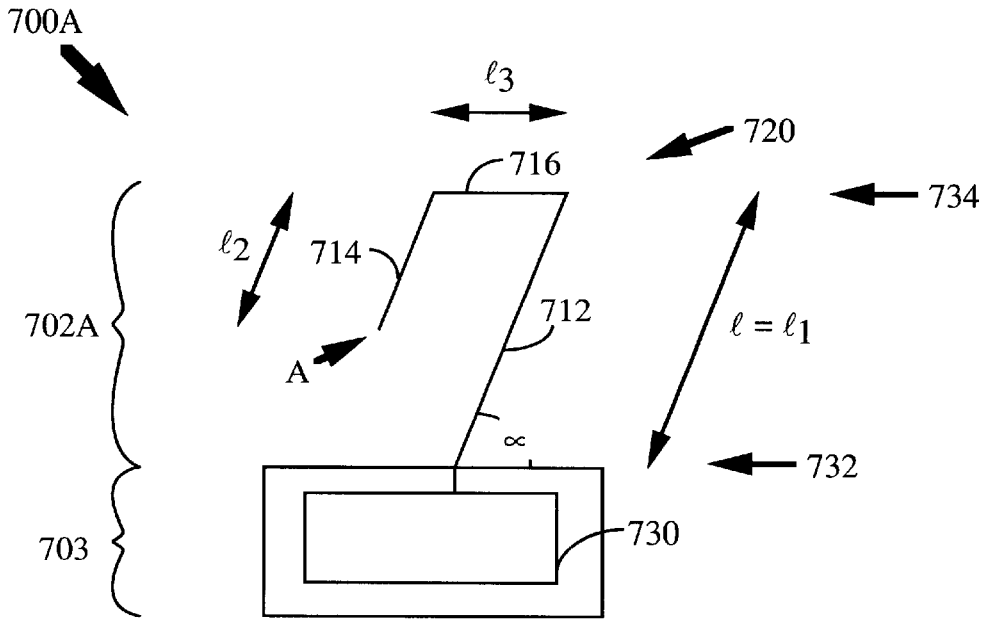
FIG. 7A is a diagram illustrating a planar representation of a quarter-wavelength bent-segment antenna according to one embodiment of the invention.
Figure 7B:
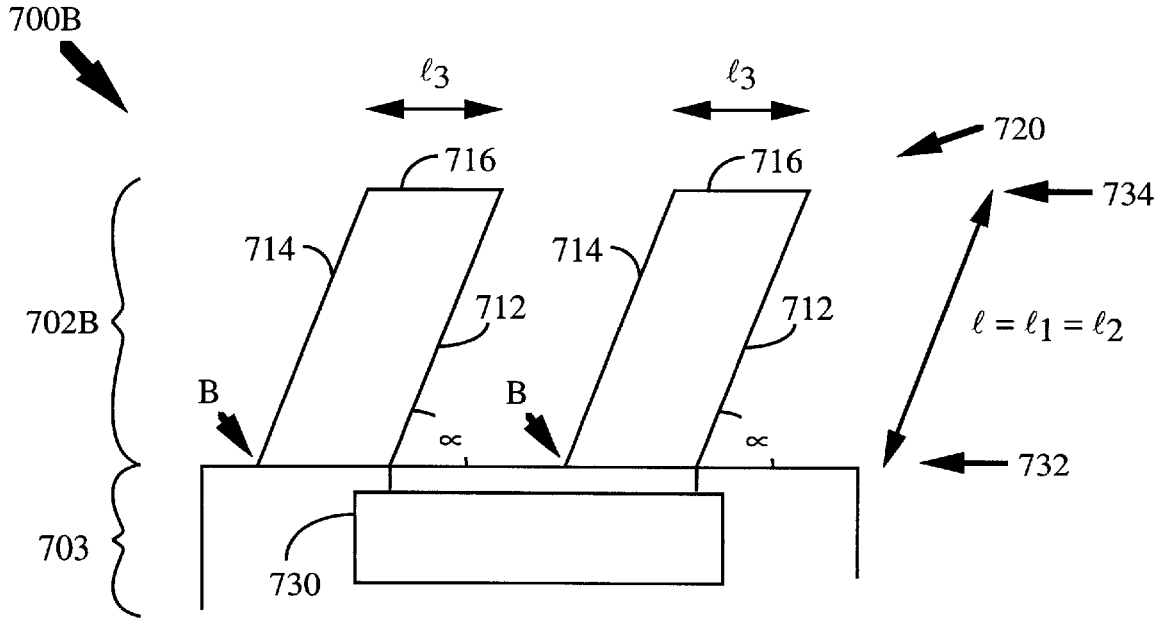
FIG. 7B is a diagram illustrating a planar representation of a half-wavelength bent-segment antenna according to one embodiment of the invention.

FIGS. 7A and 7B are diagrams illustrating planar representations of example embodiments of bent-segment helical antennas 700. Bent segment helical antenna 700 is comprised of a radiator portion 702 and a feed portion 703. Radiator portion 702 is comprised of one or more radiators 720, and has a first end 732 adjacent to feed portion 703 and a second end 734. Feed portion 703 is comprised of a feed network 730. In a quadrifilar embodiment, feed network 730 provides the quadrature phase signals used to feed radiators 720.

Each radiator 720 is comprised of a set of radiator segments. In the illustrated embodiments, this set is comprised of three segments: a first segment 712 extending from feed network 730 toward second end 734 of radiator portion 702; a second segment 714 adjacent to first segment 712; and a third segment 716 connecting the first and second segments 712, 714. These segments combine to form radiator 720 in any of a variety of different shapes that roughly approximate a "U" or other partially enclosed U-shape such as, for example, a hairpin, a horseshoe, or other similar shape. Although second segment 714 is illustrated as being parallel to first segment 712, it is not imperative that second segment 714 be parallel to first segment 712. Although substantial parallelism is preferred, alternative embodiments are possible as well.

In the embodiment illustrated in FIG. 7, the corners of radiator 720 are relatively sharp. In alternative embodiments, the corners can be rounded, beveled, or of some other alternative shape.

Radiators 720 extend from feed portion 703 at an angle $\alpha$. Preferably, all radiators 720 extend at substantially the same angle $\alpha$. As a result, when this planar structure is wrapped into a cylindrical, conical, or other appropriate shape, radiators 720 form a helix. However, the radiator angle or pitch can change along the radiator length, as desired, to shape radiation patterns or for other reasons, as would be understood by those skilled in the art.

FIG. 7A illustrates a bent-segment helical antenna 700A terminated in an open-circuit according to one embodiment. In the open-circuit embodiment, second segment 714 terminates in an open circuit at point 'A'. An antenna terminated in an open-circuit such as this may be used in a single-filar, bifilar, quadrifilar, or other x-filar implementation. A single-filar implementation is illustrated. That is, the embodiment illustrated in FIG. 7A is comprised of a single radiator 720. Alternative embodiments, such as bifilar, quadrifilar, etc. have additional radiators 720.

For an open-circuit embodiment, such as the antenna illustrated in FIG. 7A, the effective resonant length $l_R$ is an odd-integer multiple of a quarter-wavelength of the resonant frequency (i.e., $l_R=n\lambda/4$, where n=1, 3, 5, . . .). In other words, the open-circuit embodiment is a quarter-wavelength ($\lambda/4$) antenna embodiment.

FIG. 7B illustrates radiators 720 of the helical antenna when terminated in a short-circuit 722. In the short-circuit embodiment, second segments 714 of radiators 720 terminate in a short circuit at point B. That is, point B of each radiator 720 is short-circuited back to feed portion 703. This short-circuited implementation is not suitable for a single-filar antenna, but can be used for bifilar, quadrifilar or other x-filar antennas, where x>1.

For a short-circuit embodiment, such as the antenna illustrated in FIG. 7B, the effective resonant length $l_R$ is an integer multiple of a half-wavelength of the resonant frequency (i.e., $l_R=n\lambda/2$, where n=1, 2, 3, . . .). In other words, the open-circuit embodiment is a half-wavelength ($\lambda/2$) antenna embodiment.

For a resonant frequency $f=v/\lambda$ (where v is the velocity of the signal in the medium) the overall length l by which a radiator 720 (A, B) extends beyond feed portion 703 is less than the length of a corresponding conventional helical antenna. For example, the length of a radiator of a conventional quarter-wavelength helical antenna is $v\lambda/4$. In contrast, for a quarter-wavelength bent segment antenna 700A, the longest radiator segment is a length $l_1$ of first segment 712, making radiator portion 702A a length of $l_1\cos\alpha$. Note that the overall radiator length is given by $l_1+l_2+l_3\cong v\lambda/4$, and, therefore, $l_1<v\lambda/4$. Also note that in the embodiment illustrated in FIG. 7B, $l_1=l_2>>>l_3$, therefore, $l_1<v\lambda/2$ making radiator portion 702B shorter than a conventional half-wavelength helical antenna.

Figure 8A:
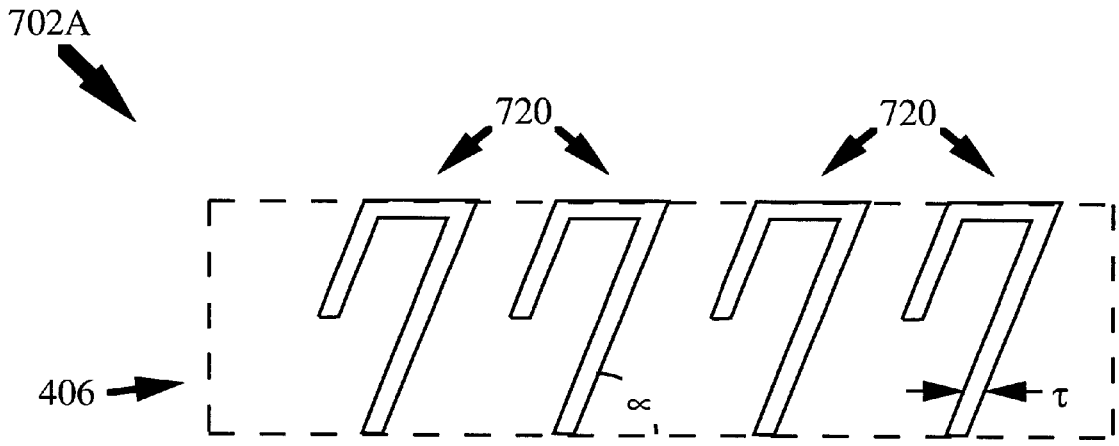
FIG. 8A is a diagram illustrating a planar representation of bent segment strip radiators of a quarter-wavelength bent-segment antenna according to one embodiment of the invention.
Figure 8B:
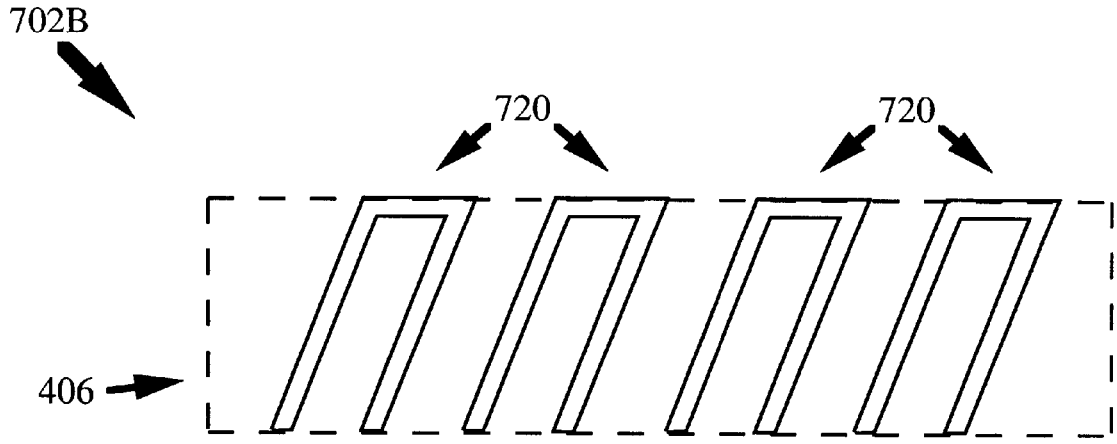
FIG. 8B is a diagram illustrating a planar representation of bent segment strip radiators of a half-wavelength bent-segment antenna according to one embodiment of the invention.

FIGS. 8A and 8B are diagrams generally illustrating planar representations of radiator portions 702 of a bent-segment helical antenna according to a strip embodiment implementation. More specifically, the bent-segment helical antenna radiator portions 702 illustrated in FIGS. 8A and 8B are implemented using strip technology. Additionally, the portions 702 illustrated in FIGS. 8A and 8B are of a quadrifilar helix embodiment having four helical radiators 720, preferably fed by quadrature phase signals having a relative phase of 90°. After reading this description, it will become apparent to a person skilled in the art how to implement the bent-segment helical antenna 700 in other embodiments having a different number of radiators and/or a different feed structure.

In the strip embodiments illustrated in FIGS. 8A and 8B, radiators 720 are comprised of copper or other conductive material deposited on a substantially planar dielectric substrate 406. Substrate 406 is then formed into a cylindrical, conical, or other appropriate shape such that radiators 720 are wrapped in a helical configuration.

Figure 9A:
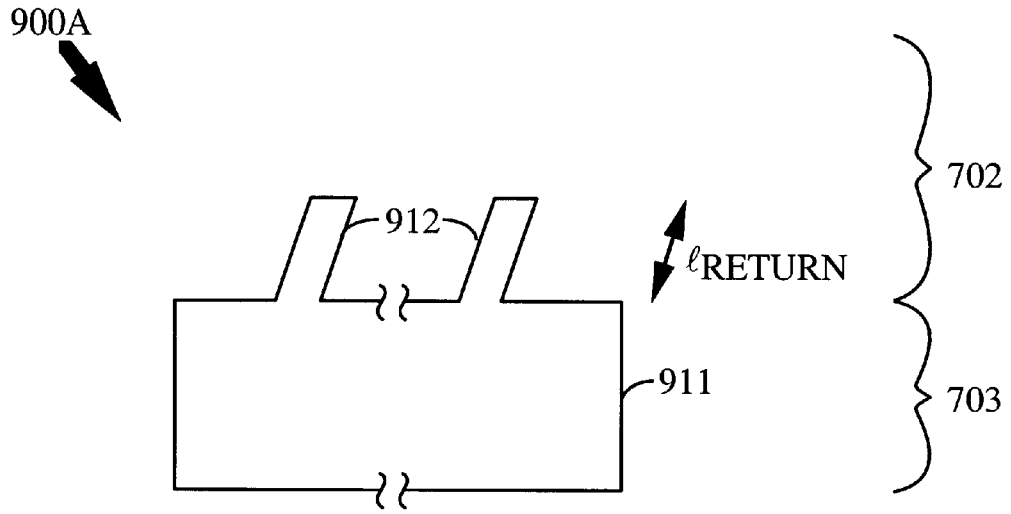
FIG. 9A is a diagram illustrating a planar representation of a ground plane and feed returns for a strip antenna according to one embodiment of the invention.
Figure 9B:
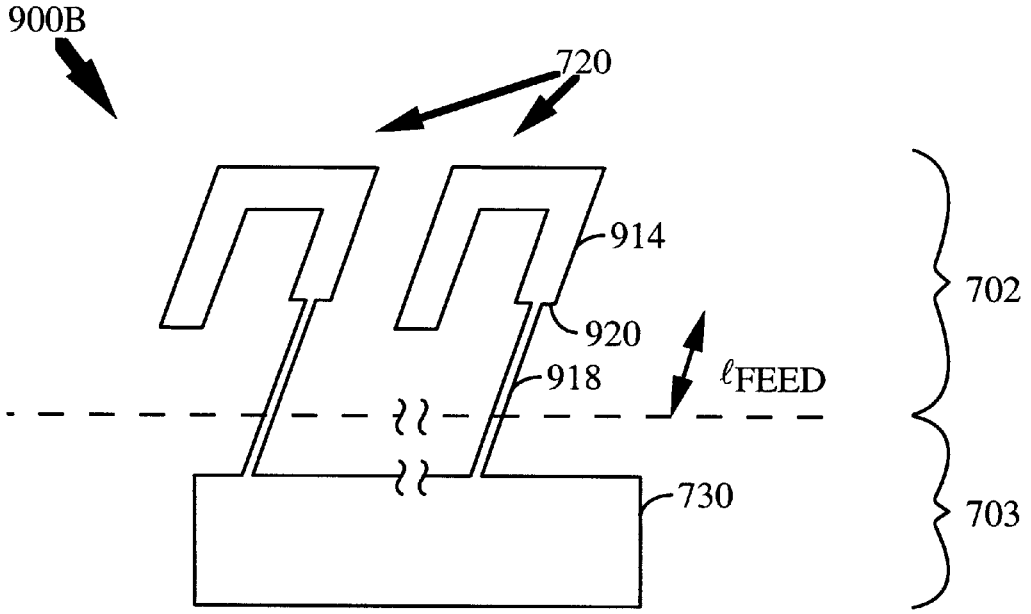
FIG. 9B is a diagram illustrating a planar representation of strip radiators and a feed network of a quarter-wavelength bent-segment antenna according to one embodiment of the invention.
Figure 9C:
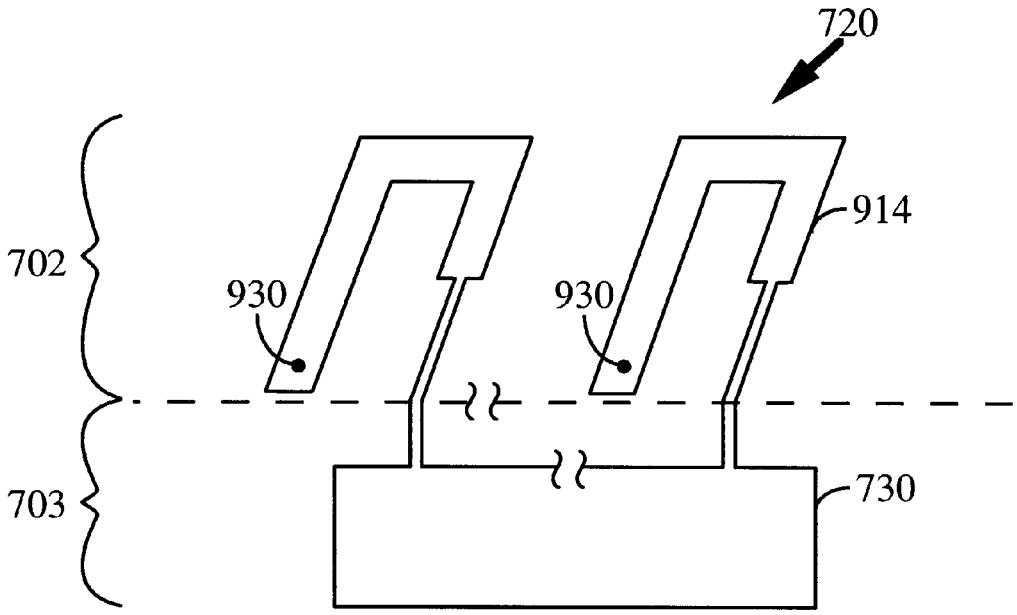
FIG. 9C is a diagram illustrating a planar representation of strip radiators and a feed network of a half-wavelength bent-segment antenna according to one embodiment of the invention.

FIG. 9A illustrates a far surface of an antenna 700 implemented using strip technology according to one embodiment of the invention. FIGS. 9B and 9C illustrate a near surface of an antenna 700 implemented using strip technology according to one embodiment of the invention. FIG. 9B illustrates radiators 720 implemented in an open-circuit quarter-wavelength ($\lambda/4$) embodiment. FIG. 9C illustrates radiators 720 implemented in a short-circuit half-wavelength ($\lambda/2$) embodiment.

Referring now to FIG. 9A, far surface 900A is comprised of a ground plane 911 and radiator sections or portions 912. Ground plane 911 provides a ground plane for feed network 730, which is on near surfaces 900B, 900C. Ground plane 911 and radiator sections 912 are described in greater detail in conjunction with the description of near surface 900B, 900C.

Referring now to FIG. 9B, near surface 900B has sections or portions of one or more radiators 720 deposited thereon (two are illustrated). As described above, radiators 720 are comprised of a plurality of segments 712, 714, and 716. In the embodiment illustrated in FIGS. 9A and 9B, first segment 712 of each radiator 720 is formed by a first radiator section 914 on near surface 900B and a second radiator section 912 on far surface 900A. A feed line 918 is used to transfer signals to and from radiator segment 712 at the end of radiator section 914 on near surface 900B. The area where feed line 918 meets radiator portion 914 is referred to as the feed point 920 of antenna 700.

Feed line 918 is disposed on the substrate such that it is opposite and substantially centered over radiator section 912. While the position of feed line 918 over ground plane 911 may follow the angle of radiator section 912, this is not a requirement and it may connect to feed network 730 at a different angle, as shown in FIG. 9C.

The length of feed line 918 $l_{feed}$ is chosen to optimize impedance matching of the antenna to feed network 730. The length of feed line 918 $l_{feed}$ is chosen to be slightly longer than radiator section 912, designated here as $l_{return}$. Specifically, in one embodiment, $l_{return}$ is 0.01 inches (2.5 mm) shorter than $l_{feed}$, so that there is an appropriate gap between the ends of radiator sections 912 and 914 which feed line 918 crosses or extends over.

Figure 9D:
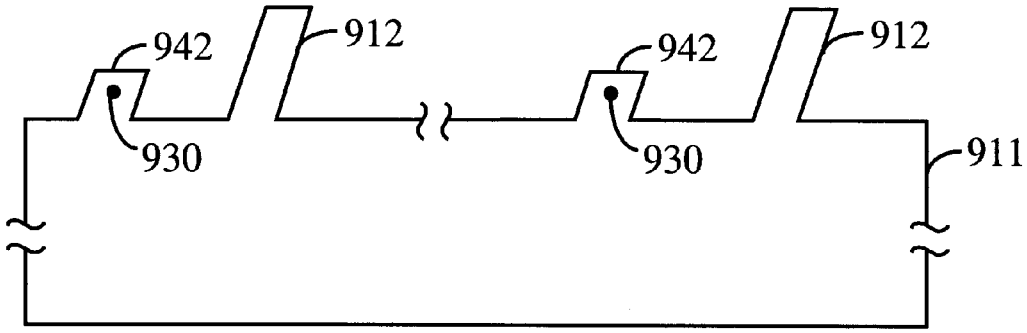
FIG. 9D is a diagram illustrating a planar representation of a ground plane, fingers and feed returns for a strip antenna according to one embodiment of the invention.

Referring now to FIG. 9C, for half-wavelength embodiments, second segment 714 extends to a length longer than that of the quarter-wavelength embodiments, relative to first segment 712. A via hole 930 or other structure is provided for making an electrical connection between second segment 714 and ground plane 911. This provides an electrical connection (short circuit) between segments 714. In one embodiment (not illustrated) segments 714 extend into feed portion 703. In an alternative embodiment illustrated in FIG. 9D, fingers 942 are extended from ground plane 911 into radiator portion 702 of the antenna such that fingers 942 and segments 714 overlap a sufficient amount to allow the electrical connection. In addition, alternative structures can be implemented to provide the electrical connection between segments 714.

For quarter-wavelength embodiments, second segment 714 is not shorted to ground plane 911. Thus, the ends of radiators 720 are electrically open allowing radiators 720 to resonate at odd-integer multiples of quarter-wavelength. In one embodiment, second segment 714 is of a short enough length that it does not even overlap ground plane 911.

Figure 10:
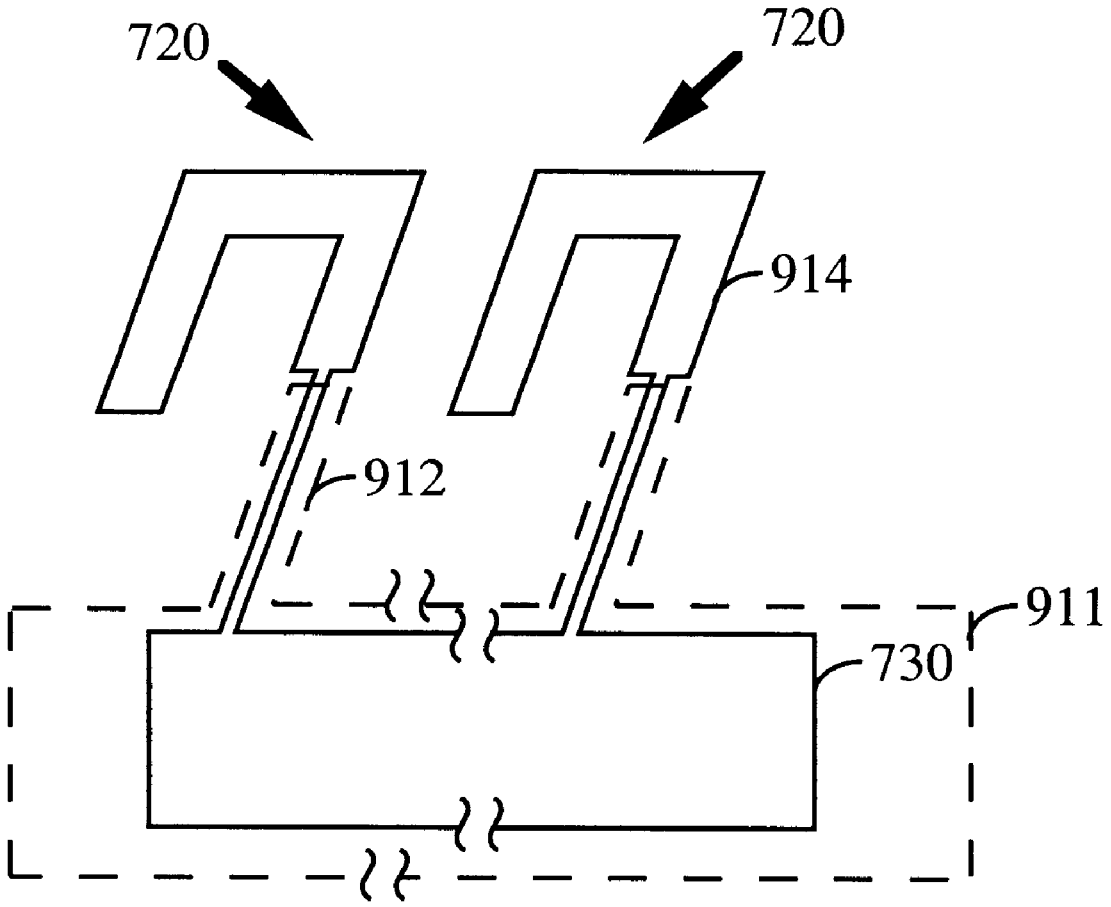
FIG. 10 is a diagram illustrating a planar representation of a ground plane, feed returns, a feed network and strip radiators for a quarter-wavelength strip antenna according to one embodiment of the invention.

FIG. 10 is a diagram illustrating near surface 900B superimposed with far surface 900A for a half-wavelength embodiment of the bent-segment quadrifilar helical antenna 800B. The microstrip conductors on far surface 900A are illustrated using dashed lines. FIG. 10 illustrates how feed lines 968 are disposed opposite to and substantially centered on radiator sections or portions 912.

In the strip embodiments illustrated and described above, each segment 712, 714, 716 is described as being on the same side of the dielectric substrate. In alternative embodiments, this is not a requirement. Determination of a side on which to etch one or more segments can be made based on fabrication, maintenance or other physical requirements. For example, for ease of repair or tuning (by trimming), it may be desirable to place certain components (such as the feed network or the second segments 714) such that they are on the outside of the cylinder.

For example, in one alternative embodiment, second segments are on the far side of the substrate while the first and third segments are on the near side. In this embodiment, the second segment 714 is connected to the corresponding third segment 716 using a via hole or other structure for providing the electrical connection. Note that in this embodiment, segments can be easily connected to ground plane 911 on the far side by extending their length to the feed portion 703 of the antenna.

Various embodiments of a bent-segment helical antenna are described above. As will become apparent to a person skilled in the relevant art after reading this description, there are numerous alternative embodiments of the invention in which a U-shaped radiator is implemented. For example, in some of the embodiments illustrated above, bent-segment radiators 720 are described as being excited using an antenna feed. In alternative embodiments, bent-segment radiators 720 can operate in a parasitic fashion, in which currents are induced from another source, or even from another antenna.

Figure 11A:
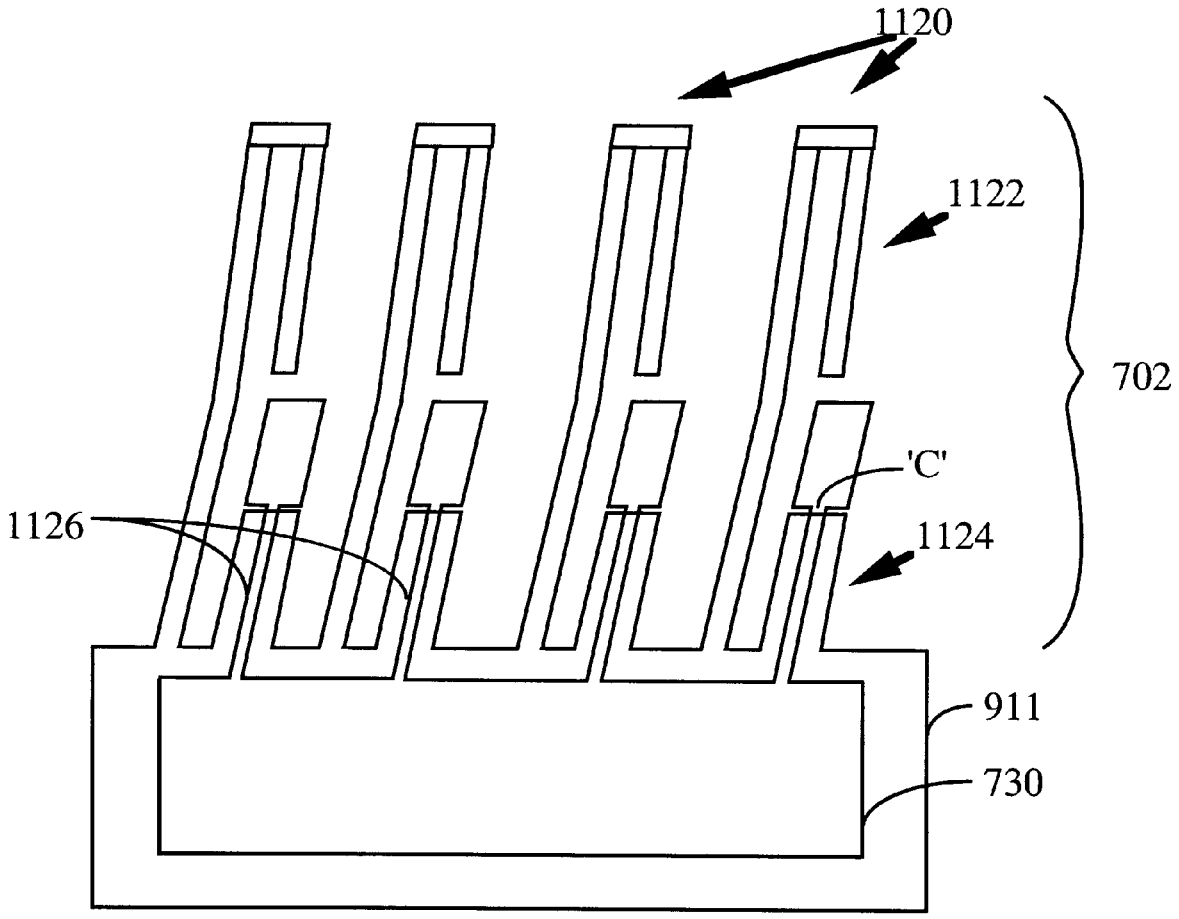
FIG. 11A is a diagram illustrating an embodiment of the antenna in which the radiators are passively coupled.
Figure 11B:
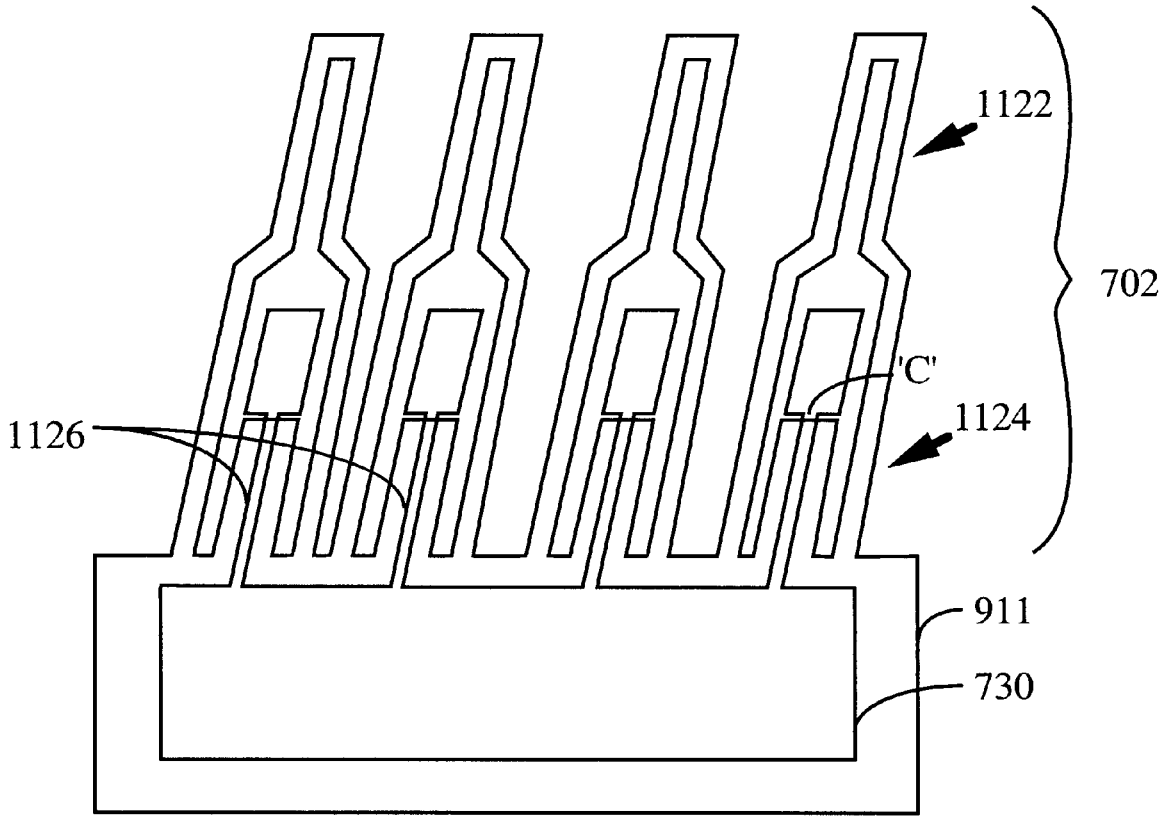
FIG. 11B is a diagram illustrating an alternative embodiment of the antenna in which the radiators are passively coupled.

FIGS. 11A and 11B illustrate two examples of an embodiment where bent-segment radiators operate parasitically. Referring now to FIGS. 11A and 11B, radiators 1120 include a parasitic bent-segment or U-shaped portion 1122 and an active portion 1124. A set of feedlines 1126 connect to active portions 1124 at feed point C, and transfer signals to and from feed circuit 730. Currents induced in active portion 1124 through feed point C are coupled to parasitic U-shaped portion 1122. FIG. 11A illustrates an embodiment where bent-segment portion 1122 is disposed along one side and at the end of active portion 1124. FIG. 11B illustrates an embodiment where U-shaped portion 1122 connects to ground plane 911, completely surrounding active portion 1124 on three sides.

One advantage of the embodiments illustrated in FIGS. 11A and 11B is that for half-wavelength embodiments, an end of U-shaped portion 1122 can be connected to ground plane 911 without via holes. This can be accomplished by depositing the entire U-shaped portion 1122 on far surface 900A. One advantage of the configuration illustrated in FIG. 11A is that for a given radiator portion width, active portion 1124 can be of a width greater than that of active portion 1124 in FIG. 11B. Thus, the embodiment illustrated in FIG. 11A can offer increased bandwidth operation over the embodiment illustrated in FIG. 11B without requiring an increase in the diameter of the antenna.

The previous description of the preferred embodiments is provided to enable any person skilled in the art to make or use the present invention. While the invention has been particularly shown and described with reference to preferred embodiments thereof, it will be understood by those skilled in the art that various changes in form and details may be made therein without departing from the spirit and scope of the invention.

What I claim as the invention is:

1. A helical antenna comprising a radiator portion having one or more helically wound radiators operating at preselected frequencies with first and second ends extending from a first end to a second end of the radiator portion, each of said one or more radiators comprising:

at least one first radiator segment extending from the first end of the radiator portion toward the second end of the radiator portion;

at least one second radiator segment adjacent to said first radiator segment and extending from the second end toward the first end of the radiator portion where it terminates as the end of the radiator, being spaced apart from and overlapping along a length of said first radiator segment; and at least one third radiator segment connecting said first radiator segment and said second radiator segment in series adjacent said second radiator portion end to form a complete radiator structure that is directed toward said second end radiator portion and then redirected back toward said first radiator portion end where it terminates.

2. The helical antenna of claim 1, wherein said radiator segments comprise strips of conductive material deposited on a dielectric substrate, wherein said dielectric substrate is shaped such that the radiators are wrapped in a helical fashion.

3. The helical antenna of claim 2, wherein said dielectric substrate is formed into one of a cylindrical shape or a conical shape.

4. The helical antenna of claim 1, wherein said segments are wire segments.

5. The helical antenna of claim 1, wherein said segments total $n\lambda/4$ in length, where $\lambda$ is the wavelength of a resonant frequency of the antenna.

6. The helical antenna of claim 1, comprising four radiators and further comprising a feed network for providing a quadrature phase signal to said four radiators.

7. The helical antenna of claim 1, further comprising a feed point for each said radiator that is positioned at a distance from said first end along said first segment, wherein said distance is chosen to match the impedance of the radiators to a feed network.

8. The helical antenna of claim 1, having a plurality of radiators, wherein each second radiator segment is electrically connected to each other.

9. The helical antenna of claim 8, wherein said electrical connection is made using a via to connect an end of each segment to a ground plane on a feed portion of the antenna.

10. The helical antenna of claim 1, wherein said one or more radiators are connected to a feed network at said first segment.

11. The helical antenna of claim 10, wherein said segments are electrically connected to a ground plane opposite said feed network.

12. The helical antenna of claim 11, wherein said segments are electrically connected to fingers extending from said ground plane into said radiator portion of the antenna.

13. The helical antenna of claim 1, wherein said first radiator segment comprises a conductive strip which is substantially parallel to a conductive strip forming said second radiator segment.

14. The helical antenna of claim 1, further comprising an active portion adjacent to said first, second and third radiator segments; wherein said first second and third radiator segments form a passive portion, parasitically coupled to the active portion.

15. The helical antenna of claim 14, wherein said passive portion surrounds said active portion on three sides.

16. The helical antenna of claim 1, wherein said first and second radiator segments are substantially equal in length.

17. The helical antenna of claim 1, wherein one of said first and second radiator segments is longer in length.

18. The helical antenna of claim 1, wherein said a third segment connecting said first segment and said second segment comprises a bent back portion.

19. The helical antenna of claim 18, wherein said a third segment comprises a U-shaped segment.

20. The helical antenna of claim 18, wherein said a third segment comprises a V-shaped segment.

21. The helical antenna of claim 1, wherein said a third segment comprises an arcuate segment.

22. The helical antenna of claim 1, wherein there are at least two first radiator segments connected in series extending from the first end of the radiator portion toward the second end of the radiator portion.

23. The helical antenna of claim 1, wherein there are at least two second radiator segments connected in series extending from the first end of the radiator portion toward the second end of the radiator portion.

24. The helical antenna of claim 1, wherein there are at least two third radiator segments connected in series extending from and connecting said first and second radiator segments in series adjacent said second radiator portion end.

25. A helical antenna, comprising:

a helical radiator portion having one or more helical radiators with first and second ends extending from a first end to a second end of the radiator portion, each of said one or more radiators comprising:

a first radiator segment extending from the first end of the radiator portion toward the second end of the radiator portion;

a second radiator segment adjacent to said first radiator segment and extending from the second end toward the first end of the radiator portion where it terminates as the end of the radiator being spaced apart from and overlapping along a length of said first radiator segment; and a third radiator segment connecting said first radiator segment and said second radiator segment in series adjacent said second radiator portion end; and a feed portion comprising a feed network connected to said first segment of said one or more radiators.

26. The helical antenna of claim 25, wherein said radiator segments comprise strips of conductive material deposited on a dielectric substrate, wherein said dielectric substrate is shaped such that the radiators are wrapped in a helical fashion.

27. The helical antenna of claim 26, wherein said dielectric substrate is formed into one of a cylindrical shape or a conical shape.

28. The helical antenna of claim 25, comprising four radiators and wherein said feed network comprises means for providing a quadrature phase signal to said four radiators.

29. The helical antenna of claim 25, further comprising a feed point for each said radiator that is positioned at a distance from said first end along said first segment, wherein said distance is chosen to match the impedance of the radiators to said feed network.

30. A helical antenna comprising a radiator portion having one or more helically wound radiators with first and second ends extending from a first end to a second end of the radiator portion, each of said one or more radiators comprising: a first radiator segment extending from the first end of the radiator portion toward the second end of the radiator portion;

a second radiator segment adjacent to said first radiator segment and extending from the second end toward the first end of the radiator portion being spaced apart from and overlapping along a length of said first segment;

a third radiator segment connecting said first segment and said second radiator segment adjacent said second end;

said first radiator segment comprises first and second sub-segments connected in series with each other such that they are offset from a common central axis and extending from said first end of the radiator portion to said third radiator segment;

said second radiator segment comprises third and fourth sub-segments connected in series with each other such that they are offset from a common central axis and extending from said third radiator segment toward said first end of the radiator portion;

said first and fourth sub-segments are separated by a first pre-selected width such that a fourth radiator segment can be disposed therebetween; and said second and third sub-segments are separated by a second pre-selected width narrower than said first pre-selected width.

31. The helical antenna of claim 30, wherein said first and fourth sub-segments are substantially equal in length, and said second and third sub-segments are substantially equal in length.

32. The helical antenna of claim 30, wherein said first and fourth sub-segments are substantially unequal in length.

33. The helical antenna of claim 30, wherein said sub-segments substantially enclose said fourth radiator segment on all sides.

34. The helical antenna of claim 30, wherein said sub-segments do not substantially enclose said fourth radiator segment on all sides.

* * * * *